United States Patent [19]

Lauzier

[11] 3,973,756

[45] Aug. 10, 1976

[54] RAILING AND METHOD OF ASSEMBLY

[75] Inventor: Rene Lauzier, Ruy, France

[73] Assignee: Cegedur GP, Paris, France

[22] Filed: Jan. 30, 1975

[21] Appl. No.: 545,586

Related U.S. Application Data

[63] Continuation-in-part of Ser. No. 220,033, Jan. 24, 1972, abandoned.

[52] U.S. Cl. ..... 256/21; 256/65

[51] Int. Cl.[2] ..... B21F 27/00

[58] Field of Search ..... 256/21, 59, 22, 24, 256/65

[56] References Cited

UNITED STATES PATENTS

| | | | |
|---|---|---|---|
| 3,482,819 | 12/1969 | Leurent | 256/21 |
| 3,485,006 | 12/1969 | De Rosario | 256/65 |

*Primary Examiner*—Werner H. Schroeder
*Assistant Examiner*—Doris L. Troutman
*Attorney, Agent, or Firm*—McDougall, Hersh & Scott

[57] ABSTRACT

A railing device formed of a plurality of support bars and a pair of elongate rail members secured in spaced apart parallel relation by said support bars in which the support bars and rail members are interconnected in their assembled relationship by means of ribs extending inwardly from the side walls of the rail member and corresponding grooves extending inwardly from the side walls of the end portions of the support bars which extend through an opening in the base portion of the rails into the space between the side walls of the rail members to establish an interconnected relationship therebetween.

13 Claims, 9 Drawing Figures

RAILING AND METHOD OF ASSEMBLY

This is a continuation-in-part of my copending application Ser. No. 220,033, filed Jan. 24, 1972, now abandoned and entitled "Protective Railing Device".

This invention relates to the construction of protective railing and to elements employed and to a method for the assembly of same.

In the aforementioned copending application, description is made of a new and improved railing having a pair of elongate rails of U-shape, including an upper rail and a lower rail maintained in spaced parallel relation by a plurality of rigid bars spaced longitudinally along the rails. The bars are provided with a groove in the opposite side walls and spaced from the end. The grooves are adapted to receive offsets extending inwardly from opposite side walls of the rails when the ends of the bars are inserted through longitudinally spaced openings in the base of the rails. The offset in the side walls of the rails extend inwardly in the direction towards each other to a spaced relationship between their peaks which is less than the width of the end portion of the bar so that when the end portion of a bar is displaced relative to the rail, through the opening and into the space between the side walls, the bar will engage the offset to effect outward deflection of the side walls until the grooves become crosswise aligned with the offsets to enable the offsets to become seated therein. Thus the side walls of the rail members return to normal position elastically to engage the portion of the bar therebetween in a manner to maintain the bars and rails in the desired railing assembly.

It is an object of this invention to provide a railing structure or balustrade in which improvements are made available from the standpoint of solidity of the assembled members as well as in reduction in the amount of material required, thereby further to reduce the cost of the railing without loss in the ease of fabrication of the parts, and assembly, and the ability of the assembled railing to offer the desired protection.

One of the characteristics desired to be embodied in a protective railing of the type described is the ability to withstand violent impacts. For example, a blow against one or more of the bars, midway between the rails, represents a most unfavorable situation. An analysis shows, on the one hand, that such impact causes deformation of the bar which results in reducing the spaced relationship between its ends and, on the other hand, the bar is shifted in the crosswise direction. This type of double action causes the portion of the rails anchored onto the ends of the bars to twist. Thus the projection on the side of the rail opposite that receiving the impact, asserts a powerful traction on the upper side of the groove in which it is seated. Since the bar is weakened at the grooved portion, it is important to prevent the engaged portion of the bar from being disengaged by the blow.

This problem can be solved in various ways, such as by increasing the height of the terminal portion with corresponding undesirable increase in the weight of the rail, or by increasing the thickness of the metal bars. Either solution requires more than 50% increase in the amount of metal, thereby correspondingly to increase the cost of the assembly.

Another limitation imposed by the preferred use of anodized aluminum in fabricating the rail member is the limitation imposed on the amount of bend to which the base member is subjected in response to the camming action on the side walls upon engagement with the bar. Excessive bending will cause the brittle anodized layer to chip and render the rail incapable of use.

For purposes of illustration, but not by way of limitation, the invention will now be described with reference to the accompanying drawings in which.

Figure 1:
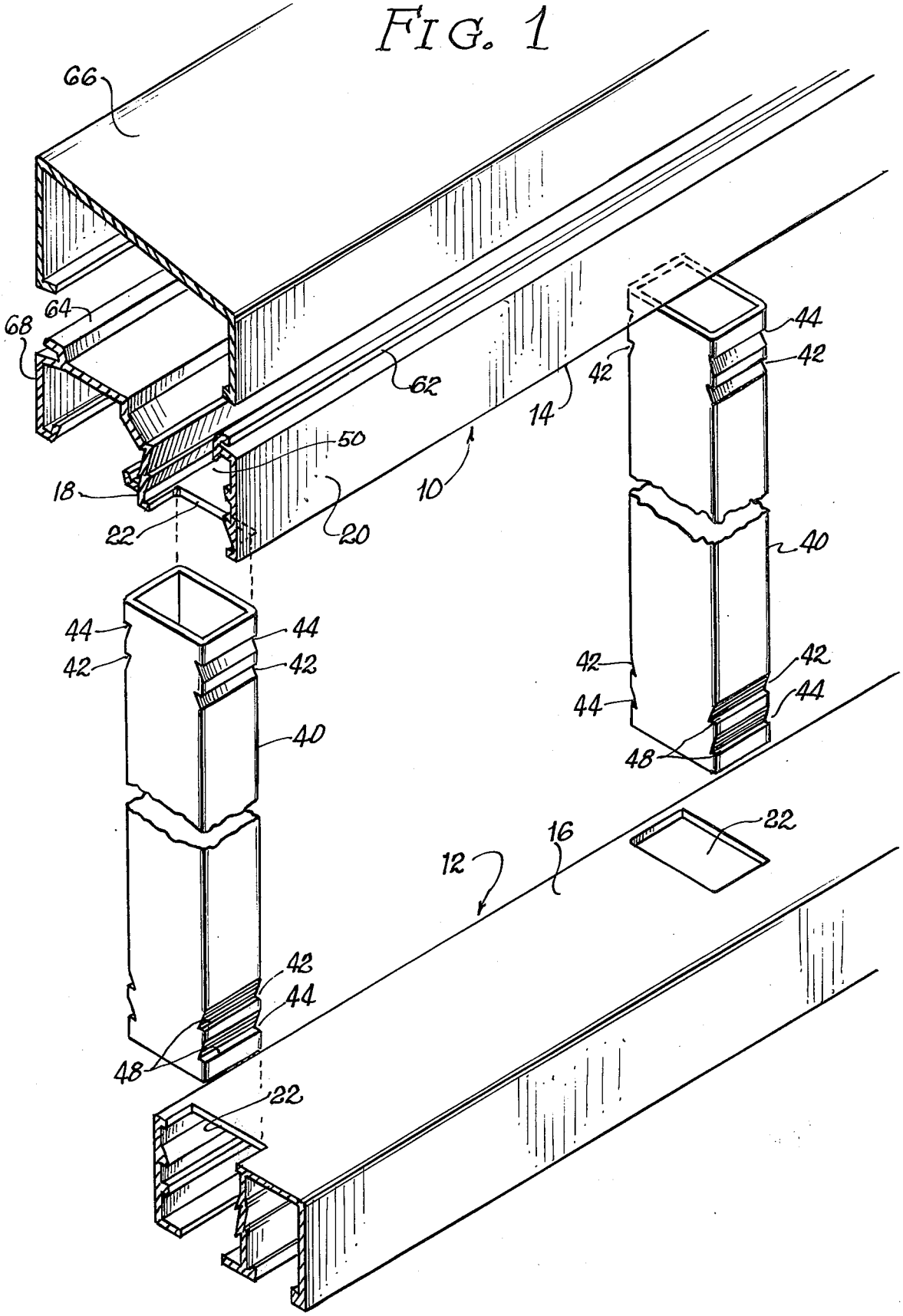
FIG. 1 is a perspective view, partially in section, of the elements making up the railing assembly of the invention, with the elements shown in their relative position for assembly.
Figure 2:
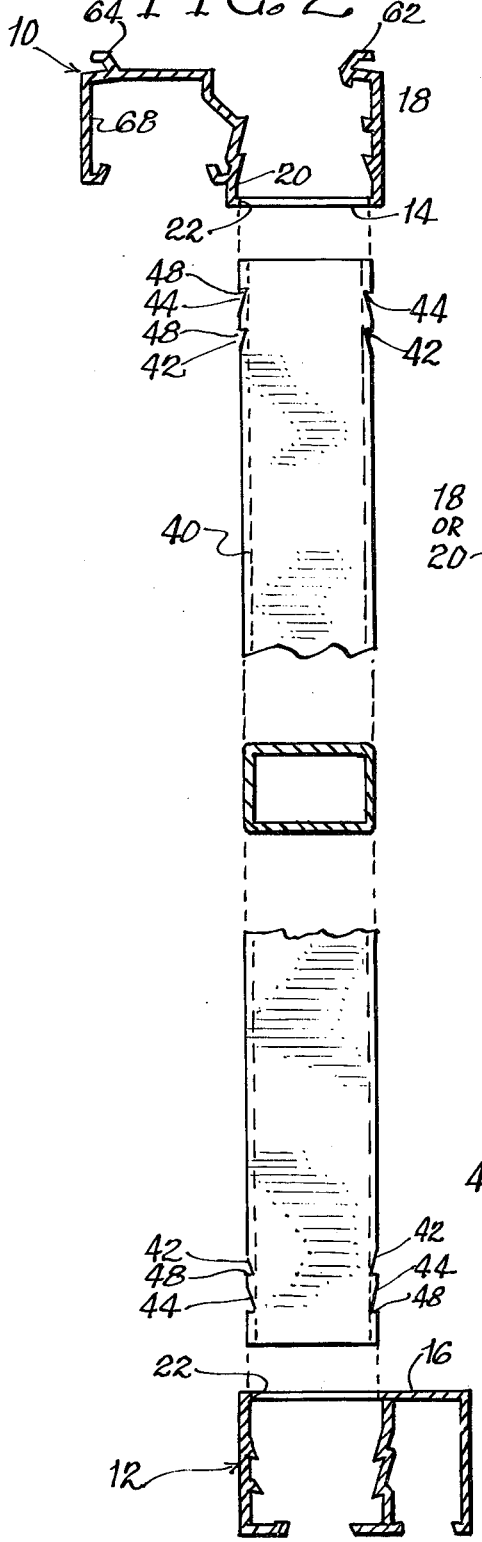
FIG. 2 is a sectional elevational view of the railing shown in FIG. 1.
Figure 7:
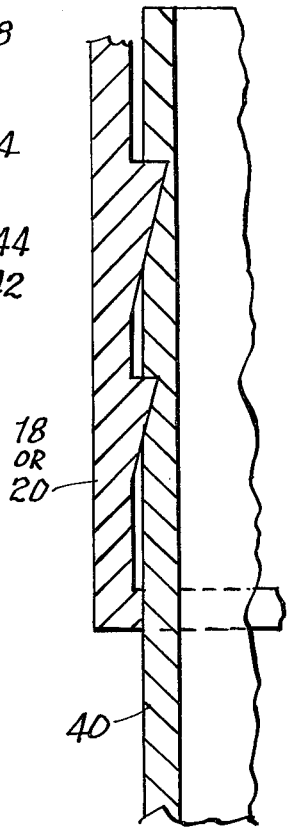
FIG. 7 is a schematic view similar to that of FIG. 6 showing the parts in their assembled relation.
Figure 3:
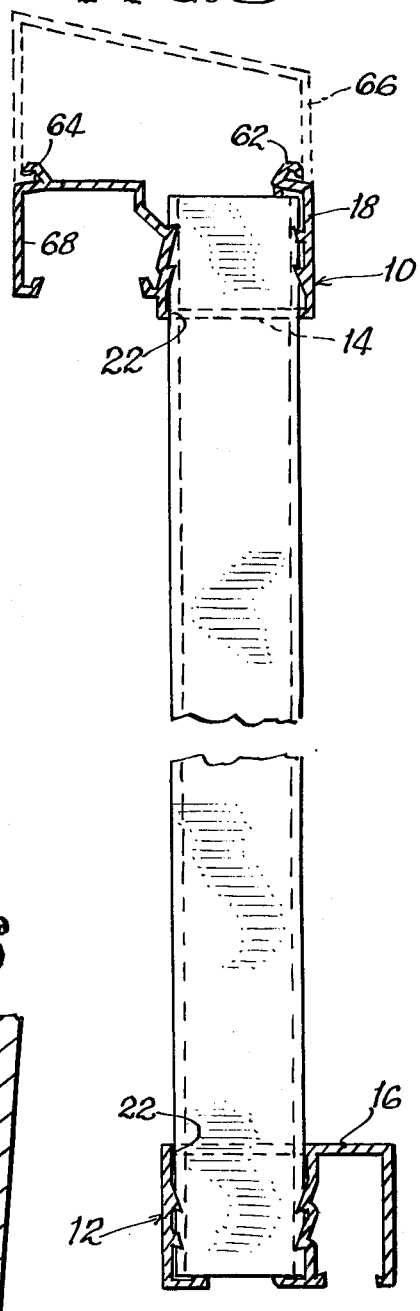
FIG. 3 is a sectional view showing the relative position of the elements in their assembled relation.

In accordance with the practice of this invention, the objectives heretofore described are achieved and the solidity of the assembly is improved, without increase in the weight of the elements, and without increase in the cost of the assembly, when the upper rail and the lower rail are each formed with spaced side walls having two or more crosswise aligned and inwardly extending offsets with the amount of offset from the side walls at least equal to and preferably increasing from the offsets closest to the base portion to the offsets further away from the base portion of the rail with the bars formed with grooves in the side walls corresponding in number to the number of offsets in the rail side walls and correspondingly spaced so that the grooves will substantially simultaneously clear the offsets during displacement of the ends of the bars through the openings in the base members into the space between the side walls of the rail.

Referring now to the drawings, the essential elements of the railing assembly embodying the features of this invention comprise a pair of elongate rails 10 and 12, each of which is formed of a base member 14 and 16, respectively, and side walls 18 and 20 which extend substantially perpendicularly from the lateral edges of the base members to define an integral rail of substantially U-shaped cross-section. The base members 14 and 16 are formed with a number of longitudinally spaced openings 22, preferably of polygonal shape, and more preferably of substantially square or rectangular shape, having a width which is slightly less than the distance between the inner surfaces of the side walls 18 and 20.

The side walls 18 and 20 of the rail members are formed with crosswise aligned projections 24–26 and 28–30 extending inwardly from the inner surfaces of the side walls 18 and 20 in the direction towards each other. Each side wall is formed with at least two projections which extend parallel to the base member and are spaced one from the other and from the base member in the direction away from the base member.

At least the first projection 24–26 nearest the base member is formed with an inclined surface 32 which extends inwardly from the inner surface of the side wall nearest the base member to about the peak 34 of the projection with the spaced relation between the peaks of crosswise aligned first level of projection being spaced one from the other by an amount less than the width of the end portion of the bars.

The projections 24–26 and 28–30 in the side walls 18 and 20 can be limited to the portions of the side walls aligned with the openings 22 but it is preferred to fabricate the rail members as an extrusion whereby the projections are formed to extend continuously integrally from the side walls in the form of ribs.

The bars 40 are formed with at least the end portion dimensioned to have a width corresponding to the width of the openings 22 through the base members 14 and 16 and of a cross-sectional shape corresponding to the shape of the openings to enable the end portion of a bar to be inserted through said opening into the space between the side walls 18 and 20. The through-extending end portions of the bars are formed with recesses 42 and 44 in their side walls corresponding in number to the number of ribs in the side walls of the rail members and in the same spaced relationship. The size and depth of the grooves 42 and 44 are sufficient to receive the correspondingly located projections 24–26 and 28–30 when the bars are in their assembled relationship in the rails. In the preferred practice of this invention, the portions of the projections facing away from the base extend inwardly from the peaks at an included angle of 70°–90° and preferably about 80° ± 5° with the side walls to provide lands 46 while the portions of the grooves 42 and 44 facing in the direction away from the adjacent end of the bar extend substantially perpendicularly, and preferably at a complementary angle to the lands, from the side walls of the base of the grooves thereby to provide a ledge 48 facing in the direction opposite to the lands to bring the two into face to face relationship in the assembled relation.

To effect the assembled relation, it is only necessary to align the end of a bar 40 with an opening 22 through the base member of the rail and then effect relative movement for displacement of the end portion of the bar through the opening into the space 50 between the side walls. As the end of the bar engages the cam surface 32 of the first level of projections 24–26, the projections are cammed in the direction away from each other until the distance between their peaks 34 corresponds to the distance between the side walls of the end portion of the bar 40. Since the projections 24–26 form an integral part of the side walls 18 and 20 of the railing, such lateral displacement of the projections causes resilient displacement of the side walls with the accommodation taking place mostly by flexure in the parallel direction within the base portions 14 and 16 of the rail.

Relative movement of the end portion of the bar into the space between the side walls of the railing is continued until the grooves 42 and 44 clear the projections 24–26 and 28–30 at which time the projections snap into the grooves, the side walls return to their normal position with the ledges 48 of the bars facing the lands 46 of the projections in the side walls to establish a resilient inter-engagement therebetween in a manner to prevent disengagement from the assembled relation without making use of a special tool to spread the side walls of the railing by an amount to effect withdrawal of the projections from the grooves.

The railing is provided with a flanged portion 52 which extend inwardly from the outer ends of the side walls 18 and 20 or the abutments 54 which extend into the path of the bars to prevent displacement of the bars beyond a predetermined position for assembly.

Figure 6:
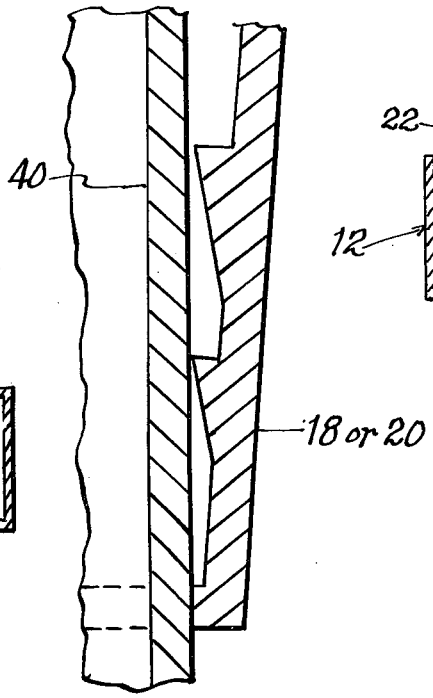
FIG. 6 is a schematic view showing the relative position of the elements during an intermediate stage of assembly.

As illustrated in FIG. 6, the angular relation that is established between the side walls 18 or 20 of the railing and the adjacent side of the bar 40, during the period of time that the bar engages the peak 34 of the first level of projections 24–26, enables the subsequent projections 28–30, etc., spaced a greater distance from the base of the railing, to project a greater distance from the side walls, thereby to increase the engageable area of the land without projecting into the path of the bar during relative movement toward the engaged position. The increase in the distance that the lands can project from the side walls will be somewhat directly proportional to the distance of the land from the base portion of the rail and will correspond to the base of a right triangle, the hypotenuse of which corresponds to the length between the land and the base of the rail, with the included angle corresponding to the angle that is formed between the side walls of the bar and the rail at the time that the peaks of the first level of projections are separated by the bar in between.

In practice, the width of the lands will be somewhat less than the maximum described but, in the preferred practice, each subsequent projection will extend for a greater distance than the preceding one. This provides for increased area of engagement between the lands and ledges and enables the first level of projections to be reduced to a minimum, with corresponding reduction in the amount of flexure of the railing members, thereby to minimize the problem of chipping of the anodized layer. This also enables noticeable reduction in the thickness of the side walls of the railing and correspondingly in the amount of metal in the railing and the cost and weight thereof.

As previously pointed out, by reason of the fact that the flexing of the side walls is dependent upon the camming action between the end portion of the bar and the cam surfaces of the first level of projections, the subsequent projections at the second, third, etc. levels need not be formed with cam surfaces since such projections will not project into the path of the leading edge of the bar, though they may project further into the space between the side walls, as previously described. Thus the projections at the subsequent levels spaced from the base of the rail can be formed of rectangular or other cross-section, as illustrated by the projections 28, but it is still preferred to form a portion **28*a* of the surface immediately in advance of the peak 34,** at a slight incline to provide a cam edge.

The cam surfaces leading to the peaks of at least the first level of projections can be inclined at an angle of ±20° but the cam angle is preferably maintained within the range of 20° ± 5°.

In order to avoid interference with the proper setting of the projections in the respective grooves of the bar, with the ledges and lands in face to face relation, the projections at the base of the lands are cut out to provide a small recessed portion 60 which is adapted to accommodate any flash or other material clinging to the edge of the recessed portion of the bar.

Means, such as projections 62 and 64, are provided in the perimeters of the railing member for receiving a cover plate 66 which conceals the area between the side walls and provides the finishing touch to the railing. Such cover plates operate also to prevent flexure of the side walls in the direction away from each other and thereby to prevent disengagement from the bars. However, such means is not an essential element of the invention.

In practice, the connecting bars 40 are in the form of hollow rectangular members of anodized aluminum dimensioned slidably to fit through the openings 22 in the base portions 14 and 16 of the rail. The bars are formed at opposite ends with identical notches 42, 44, etc., or recesses, so that the bars are interchangeable from bar to bar and from end to end so as to enable a bar of one design to be used throughout the assembly.

The elongate rail elements are also formed of extruded aluminum strip having anodized surfaces.

Figure 4:
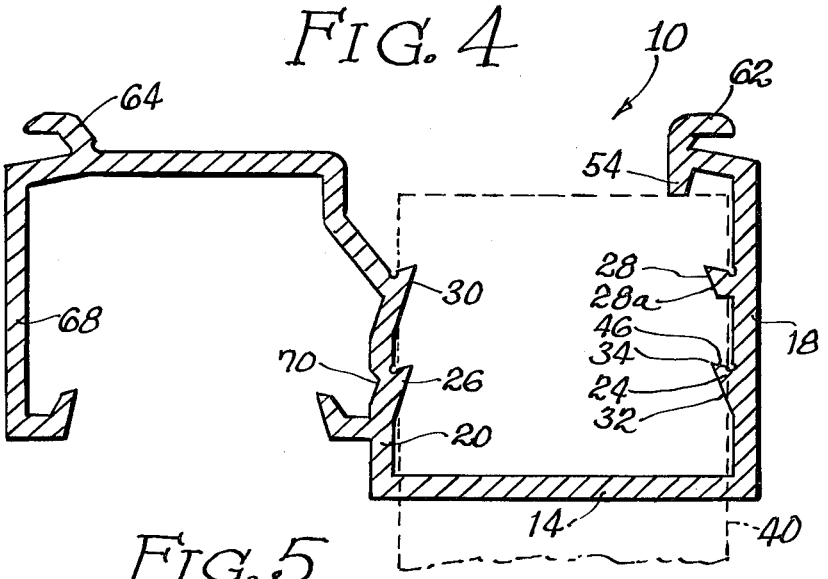
FIG. 4 is a sectional view through an upper railing member embodying the features of this invention.
Figure 8:
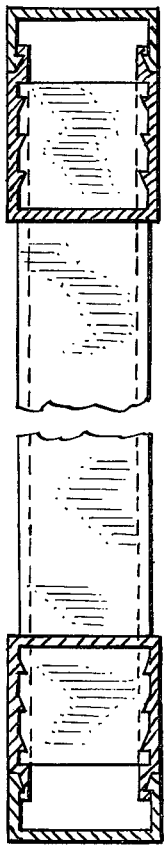
FIG. 8 is a sectional elevational view showing a modification in the rail and bar portion adapted to be interengaged in the assembled relation.
Figure 5:
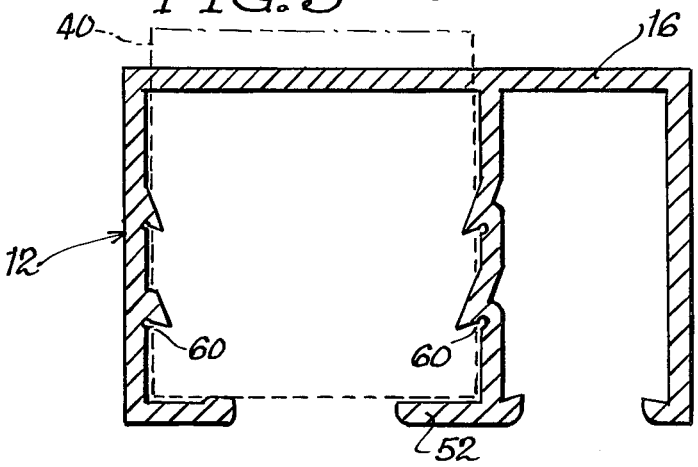
FIG. 5 is a sectional view of a lower railing member embodying the features of this invention.
Figure 9:
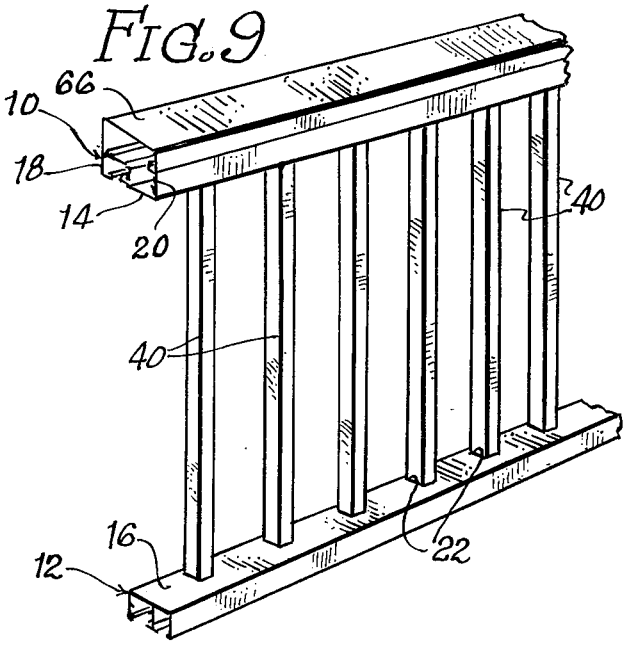
FIG. 9 is a perspective view of the assembled railing.

In practice, wherein one of the side walls 18 is exposed and the other 20 is concealed by an adjacent wall 68, as illustrated in FIGS. 4 and 5, the outer exposed wall is fabricated to present a smooth flat surface while the inner concealed wall 20 can be formed with indentations 70 to make material available for the ribbed projections thereby further to conserve on metal and weight without interfering with the appearance of the operating features of the assembly.

In assembly, the bottom rail 16 and the top rail 14 are mounted in a jig in parallel relation and spaced one from the other by an amount greater than the length of the connecting bars 40 and with their base members facing in the direction towards each other.

The bars are positioned so that a bar is located between each pair of aligned openings 22 in the base members. When all of the bars have been pre-positioned between the pair of spaced parallel rails, the rails are displaced by the jig in the direction toward each other to cause the opposite ends of the bars 40 to enter through the crosswise aligned openings in the base members for displacement into the space between the side walls. During such relative movement, the side walls of the upper and lower rail members are flexed in response to camming engagement between the ends of the bars and the projecting ribs.

A stable, elastically, gripping relationship is established between the through-extending end portion of the bars and the rail side walls as the flexed side walls return to normal position as the connecting bars are driven home and the projecting ribs of the side walls are received in the aligned grooves or recessed portions of the bars. Thereafter, the cover plate 66 is snapped onto the top rail of the assembly to complete the rail assembly.

In the event that it is desired to effect disassembly of the railing, for replacement or repair, a tool is required to spread the side walls of the railing, after the cover plate is removed, to free the projections from the recessed portions of the bars to enable retraction of the connecting bar through the rail opening.

It will be understood that the abutments 52 or stops 54 are not essential when one or more of the projecting ribs, other than the first level of projections, are squared off so that the squared portions of the projecting ribs can themselves function as stops to limit endwise displacement of the bar relative to the rail in either direction.

I claim:

1. In a railing device formed of a plurality of support bars and a pair of elongate rail members secured in spaced apart parallel relation by said support bars, the improvements wherein the rail members comprise elongate members having a base portion and side walls extending substantially perpendicularly from the lateral edges of the base portion with the side walls of one rail member extending in the direction away from the side walls of the other rail member so that the rail members define U-shaped members with oppositely facing concavities, a plurality of longitudinally spaced openings through the base portion dimensioned and shaped to correspond with the cross-sectional shape and dimension of the support bars to enable an end portion of a support bar to be projected therethrough, said rail members having at least two pairs of crosswise aligned ribs extending inwardly from the opposite side walls in substantially spaced parallel relation from the base portion, with the pair of crosswise aligned ribs at the first level adjacent the base portion having a cam surface extending from the innermost portion of the rib towards the side wall in the direction facing the base portion with the portion of said ribs facing away from the base portion extending sharply outwardly in the direction of the side walls, and grooves in the side walls of the end portion of the bars corresponding in number to the number of ribs in the side wall of the rail and in corresponding spaced relation, with the grooves being dimensioned to receive the ribs therein with the portion facing in the direction away from the adjacent end extending sharply inwardly from the side wall, the pair of ribs at the first level adjacent the base portion being spaced one from the other at their innermost portions by an amount less than the distance between the grooved side walls in the end portion of the bars whereby the cam surfaces are engaged by the end portion of a bar during endwise displacement through the opening into the space between the side walls for displacement of the side walls in the direction away from each other until the base portion clears the innermost portions of the pair of ribs at the first level and for return of the side walls to normal position with the ribs received within the grooves and with the portion of the ribs facing away from the base portion in face to face relation with the portion of the bars facing away from the ends when in the assembled relation.

2. A railing device as claimed in claim 1 in which the portion of the ribs extending sharply outwardly in the side wall extends at an angle which makes an included angle of 70°–90° with the side wall.

3. A railing device as claimed in claim 1 in which the portion of the ribs extending sharply outwardly in the side wall extends at an angle which makes an included angle of $80° \pm 5°$ with the side wall.

4. A railing device as claimed in claim 1 which includes a recessed portion at the base of the outwardly extending portion of the ribs and the side wall.

5. A railing device as claimed in claim 1 in which the rib members form an integral part of the side wall.

6. A railing device as claimed in claim 1 in which the cam surface comprises a surface which tapers from the innermost portion of the rib at an angle of $20° \pm 5°$.

7. A railing device as claimed in claim 1 in which the ribs increase in the distance from which they extend from the side wall from the pair of ribs at the first level adjacent the base portion to the pairs beyond said first level.

8. A railing device as claimed in claim 7 in which the increase in the distance from the side wall is up to an amount limited by the projection of the side wall of the bars with the side wall of the rail when the latter is displaced in response to engagement of the side wall of the bar with the innermost portion of the pair of ribs at the first level adjacent the base portion.

9. A railing device as claimed in claim 1 which includes stops spaced inwardly from the side walls of the rail member into the path of the end portion of the bar when projected through the opening in the base member of the rail.

10. A railing device as claimed in claim 9 in which the pairs of ribs are spaced from the stop by an amount corresponding to the spacing of the grooves from the end of the bar.

11. A railing device as claimed in claim 9 in which the stop comprises a flanged portion turned inwardly from the end of the side walls.

12. A railing device comprising a pair of elongate U-shaped rail members in spaced parallel relation, with the concavities of the U-shaped rail members facing in the opposite direction to provide inwardly facing bail portions with a plurality of longitudinally spaced openings therethrough and side walls extending outwardly in spaced substantially parallel relation from the lateral edges of the bail portion, at least two outwardly spaced pairs of crosswise aligned ribs facing in the direction towards each other from the side walls, and a plurality of bars, the opposite ends of which extend through aligned apertures in the bail portions of the rail members with the end portions of said bars being notched in opposite side walls corresponding in number and in spaced relation with the pairs of ribs in the side walls of the rail members for resilient engagement with said ribs when the bars extend crosswise between the rail members in their assembled relation.

13. A railing device comprising a plurality of support bars having opposite side walls and at least two spaced grooves in each side wall spaced from an end of each of the bars, said grooves having a portion facing the end which extends substantially perpendicularly from the side wall and a contiguous portion which extends from the inner crest of the groove outwardly to the side wall, an elongate rail member having a base portion with a plurality of longitudinally spaced openings dimensioned to enable passage of the end portion of a bar therethrough, and side walls extending integrally substantially perpendicularly from the lateral edges of the base portion and spaced one from the other by an amount slightly greater than the width between the side walls of the bars, with the side walls extending in a direction away from the bars, the inner surface of the side walls having at least two pairs of spaced crosswise aligned ribs facing in the direction towards each other from the side walls and corresponding in shape and spaced relation with the grooves in the bars with the peaks of the oppositedly aligned ribs in each pair being spaced one from the other by an amount less than the width between the side walls of the bars whereby, in response to endwise displacement of the end portion of a bar through an opening in the base member of the railing into the space between the side walls, a pair of ribs are engaged by the bar to cause spreading of the side walls of the rail member until the grooves of the bar clear the peaks of the ribs to enable entry of the ribs into the groove with the corresponding return of the side walls to normal position to establish an interconnected relation between the spaced walls with the bars in between.

* * * * *